US009475279B2

(12) United States Patent
Hatanaka

(10) Patent No.: US 9,475,279 B2
(45) Date of Patent: Oct. 25, 2016

(54) IMAGE FORMING METHOD, IMAGE FORMING APPARATUS, AND RECORDING MEDIUM

(71) Applicant: Shinichi Hatanaka, Tokyo (JP)

(72) Inventor: Shinichi Hatanaka, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 324 days.

(21) Appl. No.: 13/837,991

(22) Filed: Mar. 15, 2013

(65) Prior Publication Data

US 2013/0241987 A1 Sep. 19, 2013

(30) Foreign Application Priority Data

Mar. 19, 2012 (JP) ..... 2012-061983

(51) Int. Cl.
*B41J 2/21* (2006.01)
*B41J 2/045* (2006.01)

(52) U.S. Cl.
CPC ..... *B41J 2/04501* (2013.01); *B41J 2/2139* (2013.01)

(58) Field of Classification Search
USPC ..... 347/19, 12, 11
See application file for complete search history.

(56) References Cited

U.S. PATENT DOCUMENTS 6,953,238 B2 10/2005 Koitabashi et al.
7,289,248 B2 * 10/2007 Yamazaki ..... 347/19
7,708,371 B2 * 5/2010 Yamanobe ..... 347/19
7,773,252 B2 * 8/2010 Yoshida ..... H04N 1/6033 358/1.9
8,256,862 B2 9/2012 Takagi et al.
2003/0085939 A1 * 5/2003 Koitabashi ..... B41J 2/2139 347/15
2005/0057762 A1 * 3/2005 Yoshida ..... H04N 1/6033 358/1.9
2007/0070111 A1 * 3/2007 Vladislav ..... 347/19
2007/0120885 A1 * 5/2007 Jeong ..... 347/19
2009/0058910 A1 3/2009 Hatanaka et al.
2009/0167800 A1 7/2009 Hatanaka et al.
2011/0170142 A1 7/2011 Ito et al.
2012/0293579 A1 11/2012 Hatanaka
2013/0027447 A1 1/2013 Hatanaka

FOREIGN PATENT DOCUMENTS

JP 2002-019101 A 1/2002
JP 2003-205604 A 7/2003
JP 2003-276186 A 9/2003
JP 2006-103053 A 4/2006
JP 2006-173929 6/2006
JP 2006-212793 8/2006
JP 4027204 12/2007

* cited by examiner

*Primary Examiner* — Matthew Luu
*Assistant Examiner* — Lily Kemathe
(74) *Attorney, Agent, or Firm* — Oblon, McClelland, Maier & Neustadt, L.L.P.

(57) ABSTRACT

A method for forming a color image on a recording medium includes detecting an ejection failure of a group of color ink recording elements for ejecting color ink drops, storing recording data originally expected to be processed by at least one color recording element exhibiting the ejection failure of the color recording elements of the group in a case where the ejection failure is detected in the detecting step, and compensating the ejection failure by recording an achromatic dot at a pixel position to which at least one color dot is originally expected to be recorded on the recording medium based on recording data stored in a data storage unit.

8 Claims, 8 Drawing Sheets

IMAGE FORMING METHOD, IMAGE FORMING APPARATUS, AND RECORDING MEDIUM

BACKGROUND OF THE INVENTION

1. Field of the Invention

The disclosures herein relate to an image forming method, and image forming apparatus, a non-transitory recording medium storing a program suitable for carrying out inkjet printing. The inkjet printing includes ejecting plural color liquid ink particles on a recording material so as to form a predetermined character or an image.

2. Description of the Related Art

Printers employing an inkjet system (hereinafter "inkjet printers") generally produce high quality and inexpensive color printed matter. Hence, an increasing number of the inkjet printers is widely used not only in offices but is also used by general users along with the widespread use of personal computers or digital cameras.

In such inkjet printers, nozzles of recording heads discharge (eject) liquid ink particles in dots while a movable body (i.e., a carriage) integrally having ink cartridges and the recording heads reciprocate on a printing medium (i.e., a sheet) in directions orthogonal to a paper feeding direction. As a result, a predetermined character or an image is formed on a printing medium to produce desired printed matter. Further, since the carriage includes ink cartridges of four colors including black (K), yellow (Y), magenta (M), and cyan (C), and the recording heads of the respective colors, the inkjet printers not only perform monochrome printing but also carry out full color printing easily by combining these different colors (in practice, with additional colors such as light cyan and light magenta, six color cartridges, even color cartridges or eight color cartridges are used).

Further, in the above inkjet printers (generally called "multipath printers") configured to perform printing while causing the recording heads disposed on the carriage to reciprocate in directions orthogonal to the paper feeding direction, the recording heads need to reciprocate from several dozen times to 100 times or more in order to print one entire page solidly. Accordingly, the inkjet printers may require significantly longer printing time compared to other types of printers, such as laser printers employing an electrophotographic technology for use in copiers.

By contrast, in inkjet printers including recording heads having respective widths equal to or greater than a width of a printing sheet and including no carriage (generally called "line-head printers"), have recording heads that need not reciprocate in width directions of the printing sheet. That is, the line-head printers may be able to carry out one-scanning (one-path) printing to achieve high-speed printing similar to that achieved by laser printers. In addition, since the line-head printers need not have the carriage on which the recording heads are attached, enclosures of the printers may be reduced in size and weight. Further, since the line-head printers need not have a drive device for moving the carriage with the recording heads, the printers may significantly become quieter.

When a recording element for recording an image or the like malfunctions and thus is not able to perform normal recording in the line-head inkjet printer, a recorded image may have a missing part due to the malfunction of the recording element not recording the part of the recorded image. Thus, this results in a defect of the recorded image. The cause of the malfunctioning recording element may depend largely on failure to eject ink due to nozzle clogging or ink sticking to an ink-ejecting surface resulting from the breakage of a heater in the inkjet system utilizing an electrothermal energy converter generating air bubbles in the ink to eject the ink. In order to solve the above difficulty, Japanese Patent No. 4027204 (hereinafter referred to as "Patent Document 1") suggests that the defected recording element having a defect is replaced with another normal recording element to carry out recording in place of the defected recording element.

For example, Patent Document 1 discloses a technology for recording an image while retaining lightness by utilizing a recording element ejecting ink darker than ink ejected by a malfunctioning recording element while reducing the number of recording dots. Japanese Laid-open Patent Publication No. 2006-173929 (hereinafter referred to as "Patent Document 2") and Japanese Laid-open Patent Publication No. 2006-212793 (hereinafter referred to as "Patent Document 3") disclose technologies for allowing unrecorded pixels due to the malfunctioning ejection of ink to diffuse in pixels peripheral to the unrecorded pixels by detecting the unrecorded pixels and transmitting the unrecorded pixels to the peripheral pixels as errors.

RELATED ART DOCUMENTS

Patent Document

Patent Document 1: Japanese Patent No. 4027204

Patent Document 2: Japanese Laid-open Patent Publication No. 2006-173929

Patent Document 3: Japanese Laid-open Patent Publication No. 2006-212793

However, in the technology disclosed in Patent Document 1, there is a difference in a hue between ink ejected by a normal recording element and ink ejected by the malfunctioning recording element, which may adversely affect the color of the image. Further, the number of recording heads having the recording elements for ejecting plural colors of ink may need to increased. In addition, inconsistent density may be observed in characters, fine lines or a profile of the solid image (from a highlighted part to a half-tone part of the image exhibiting density variability such as spottiness) by decreasing the number of recording dots.

Accordingly, it is a general object of at least one embodiment of the present invention to provide an image forming method, and an image forming apparatus capable of compensating ejection failure (malfunctioning ejection) without increasing the number of recording heads and without affecting the appearance of the image in terms of color and lightness when some of the recording elements malfunction, which substantially eliminate one or more problems caused by the limitations and disadvantages of the related art.

SUMMARY OF THE INVENTION

In one embodiment, there is provided a method for forming a color image on a recording medium, the method being performed by an image forming apparatus having a head including a group of color ink recording elements for recording color dots composed of at least two colors of inks, a group of black ink recording elements for recording black dots composed of a black ink, a group of achromatic ink recording elements for recording achromatic dots composed of an achromatic ink having a lightness higher than a lightness of the black ink, and a data storage unit for storing data. The method includes detecting an ejection failure of the group of the color ink recording elements; storing recording data originally expected to be processed by at least one color recording element exhibiting the ejection failure of the color recording elements of the group in a case where the ejection failure is detected in the detecting step; and compensating the ejection failure by recording the achromatic dot at a pixel position to which at least one color dot is originally expected to be recorded on the recording medium based on the recording data stored in the data storage unit.

In another embodiment, there is provided an image forming apparatus having a head for forming a color image on a recording medium. In the image forming apparatus, the head includes a group of color ink recording elements for recording color dots composed of at least two color inks; a group of black ink recording elements for recording black dots composed of a black ink; a group of achromatic ink recording elements for recording achromatic dots composed of an achromatic ink having a lightness higher than the lightness of the black ink; an ejection failure detector configured to detect ejection failure of the group of the color ink recording elements for recording the color dots; a data storage unit configured to store recording data originally expected to be processed by at least one color recording element having the detected ejection failure of the color recording elements of the group in a case where the ejection failure is detected by the ejection failure detector; and an ejection failure compensation unit configured to record the achromatic dot at a pixel position to which at least one color dot is originally expected to be recorded on the recording medium based on the recording data stored in the data storage unit.

In another embodiment, there is provided a non-transitory computer-readable medium storing a program, which, when processed by a processor, causes an image forming apparatus to execute a sequence of processing, the image forming apparatus including a head for forming a color image on a recording medium, the head including a group of color ink recording elements for recording color dots composed of at least two color inks, a group of black ink recording elements for recording black dots composed of a black ink, a group of achromatic ink recording elements for recording achromatic dots composed of an achromatic ink having a lightness higher than the lightness of the black ink, and a data storage unit for storing data. The sequence of processing includes detecting an ejection failure of the group of the color ink recording elements for recording the color dots; storing recording data originally expected to be processed by at least one color recording element having the detected ejection failure of the color recording elements of the group in a case where the ejection failure is detected in the detecting step; and recording the achromatic dot at a pixel position to which at least one color dot is originally expected to be recorded on the recording medium based on the recording data stored in the data storage unit.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention as claimed.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Preferred embodiments are described below, with reference to the accompanying drawings. Initially, a configuration example of an image forming apparatus to which an image forming method according to an embodiment is applied is described with reference to FIG. 1. This embodiment illustrates yellow, magenta, cyan, and black line heads (hereinafter abbreviated as Y, M, C, and K line heads), and a line-head printer formed of an inkjet printer having achromatic line heads, as the image forming apparatus to which the image forming method is applied. Note that the image forming apparatus to which the image forming method is applied is not limited to a line-head printer; however, alternatively, a multihead printer may be employed as the image forming apparatus to which the image forming method is applied.

Figure 1:
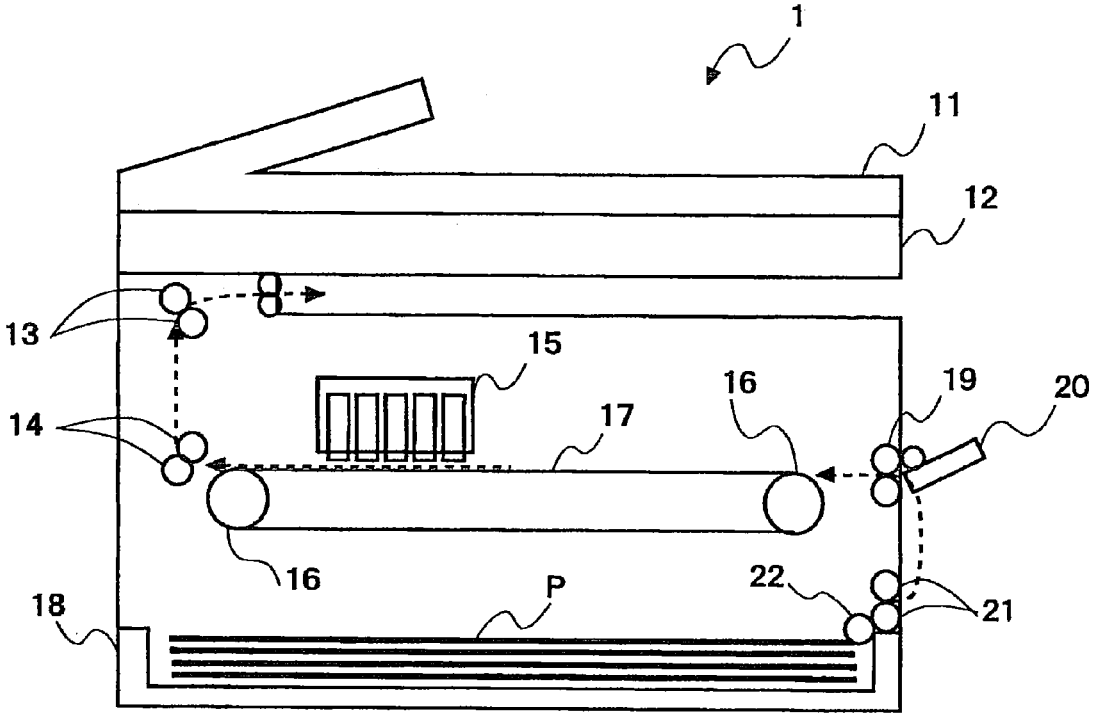
FIG. 1 is a schematic diagram illustrating an example of a line-head printer to which an image forming method according to an embodiment is applied.

FIG. 1 is a schematic diagram illustrating a configuration of a line-head printer 1 to which the image forming method according to the embodiment is applied. The line-head printer 1 includes a tray 18 configured to store recording media P, a paper-feed roller 22 configured to feed each of the recording media P to a transfer path from the tray 18 at a predetermined timing when receiving an image output request, a first transfer roller 21 configured to vertically transfer the recording medium P fed from the paper-feed roller 22, a second transfer roller 19 configured to transfer the vertically transferred recording medium P in a head direction or transfer a recording medium P from a manual bypass tray, a belt roller 16 configured to drive a transfer belt 17 to transfer the recording medium P toward the head, a line head 15, a third transfer roller 14 configured to transfer the recording medium P transferred after an image is formed on the recording medium P, and a discharge roller 13, a scanner 12, and an automatic document feeder 11. Note that the above configuration example of the line-head printer 1 employs the transfer belt (i.e., the transfer path); however, the configuration may alternatively employ a rotator such as a transfer drum.

The line-head printer 1 includes a nozzle array longer than the recording medium (i.e., a paper sheet). The nozzle array may be configured to include one or more recording heads each having ejecting nozzles aligned at fine intervals. The line-head printer 1 performs high-speed recording by operating each of the ejecting nozzles to eject ink drops while transferring the recording medium P in a direction orthogonal to a longitudinal direction of the ejecting nozzle array.

Figure 2:
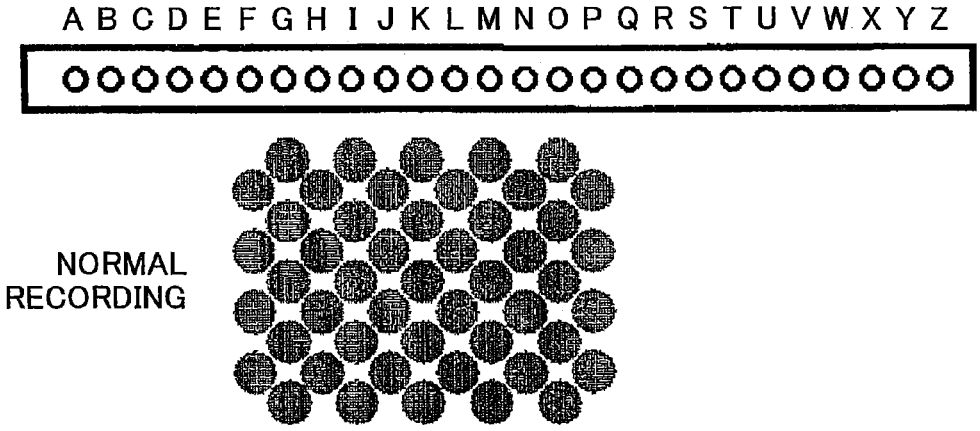
FIG. 2 is a simplified diagram illustrating a state in which recording elements perform normal operations.
Figure 3:
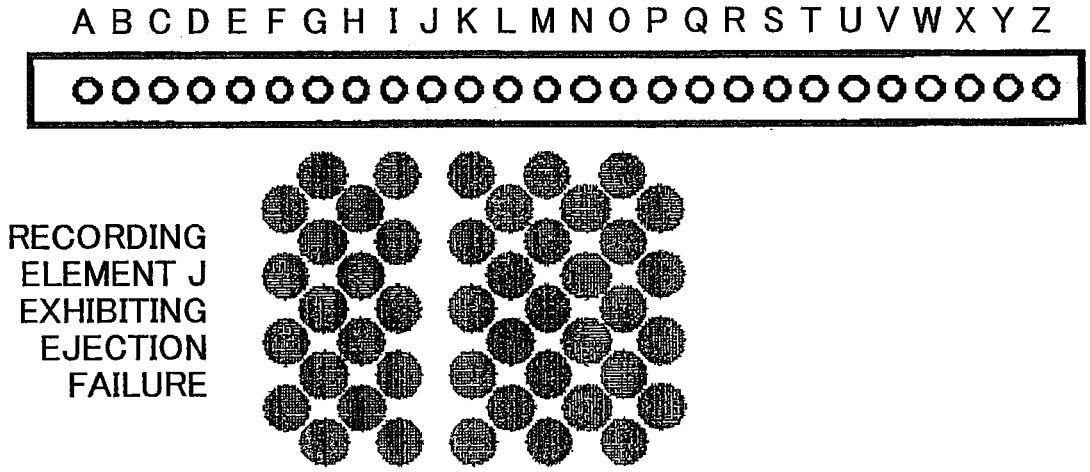
FIG. 3 is a simplified diagram illustrating a state in which a recording element exhibits ejection failure.

FIGS. 2 and 3 are schematic diagrams each illustrating an ejecting status of a one-color ink recording head in a line-head printer 1 and a recorded image. In FIGS. 2 and 3, the recording head is supplied with ejecting data for causing ejecting nozzles F to P to eject ink. FIG. 2 illustrates a state in which the ejecting nozzles F to P all perform normal ejection. By contrast, FIG. 3 illustrates a state in which the ejecting nozzle J exhibits malfunctioning ejection (i.e., ejection failure). As illustrated in FIG. 3, ink is not dropped at positions originally expected to be dropped by the ejecting nozzle J.

In general, an inkjet printer includes a recording head having four colors of ink including black (K), cyan (C), magenta (M), and yellow (Y), and ejecting nozzles (recording elements) configured to eject the respective colors of ink. The inkjet printer further includes plural recording heads having green (G), red (R), light cyan (LC), and light magenta (LM) ink, and ejecting nozzles (recording elements) configured to eject the respective colors of ink in order to increase the color gamut or in order to compensate for an ejection failure.

However, when the recording head having the nozzle exhibiting ejection failure is compensated by utilizing another recording head, the difference between ink color of the recording head having the malfunctioned nozzle and ink color of the other recording head utilized for the compensation may appear to be incongruent.

Thus, in the image forming method according to an embodiment, compensated additional ink or a compensated additional head may be restricted to one (i.e., a recording head having an ejecting nozzle configured to eject achromatic ink) by employing the recording head including the ejecting nozzle (a recording element) configured to eject achromatic ink in order to minimize incongruency of colors appearing as the color difference.

Figure 4:
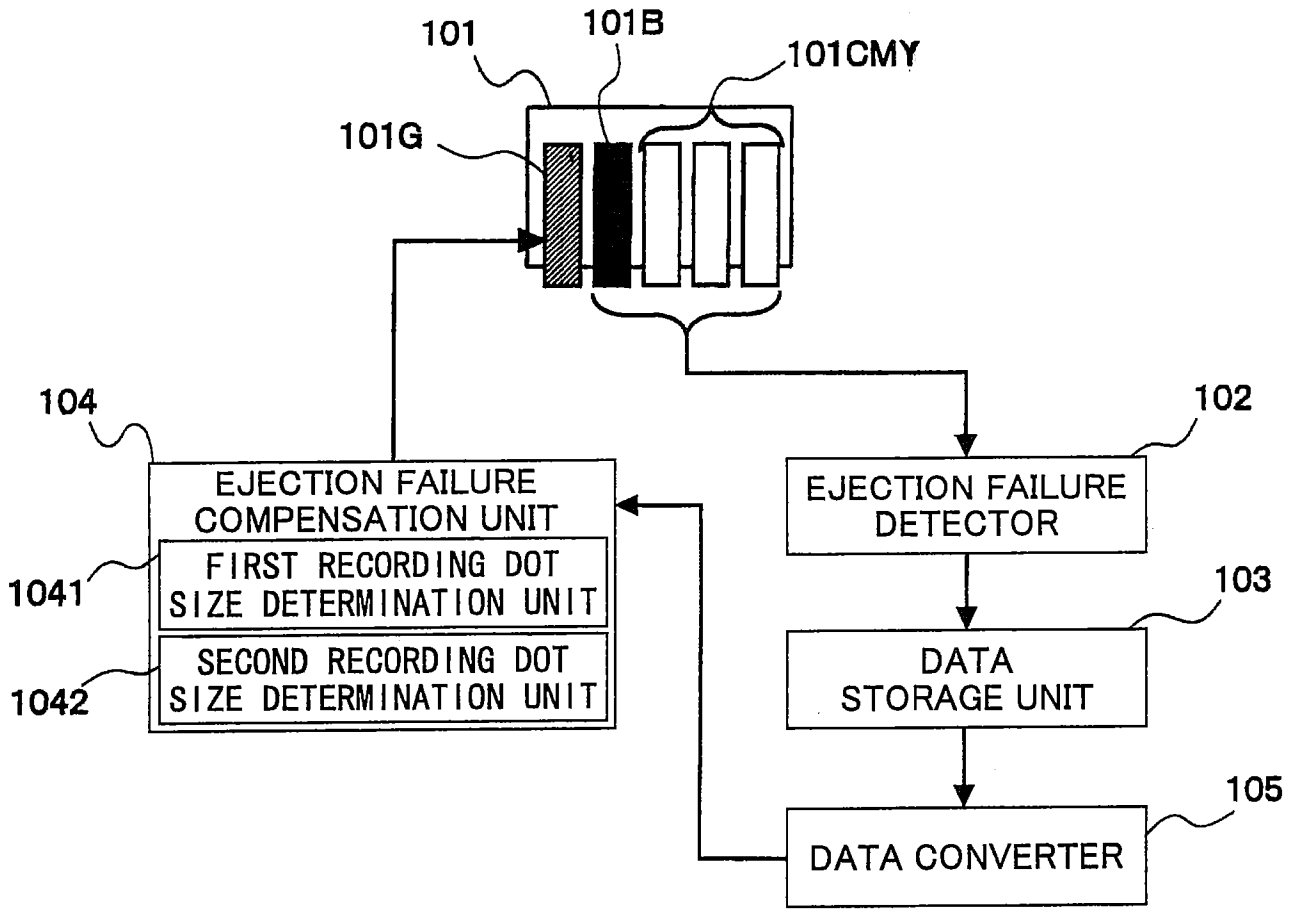
FIG. 4 is a schematic block diagram illustrating a configuration of an image forming apparatus according to an embodiment.

An image forming process performed by an image forming apparatus according to an embodiment is illustrated with reference to FIG. 4. The image forming apparatus according to the embodiment includes a recording head 101 configured to form a color image on a recording medium, an ejection failure detector 102, a data storage unit 103, an ejection failure compensation unit 104, and a data converter 105. Further, the ejection failure compensation unit 104 includes a first recording dot size determination unit 1041, and a second recording dot size determination unit 1042.

The recording head 101 includes color ink recording heads 101CMY each having plural ejecting nozzles ejecting color dots of at least two colors of inks (i.e., a group of recording elements recording color dots), a black ink recording head 101K having plural ejecting nozzles ejecting black dots of black ink (i.e., a group of recording elements recording black dots), and an achromatic ink recording head 101G having plural ejecting nozzles ejecting achromatic dots of achromatic ink having a lightness higher than that of black (i.e., a group of recording elements recording achromatic dots).

The ejection failure detector 102 detects ejection failure of one or more ejecting nozzles of the recording head 101. More specifically, the ejection failure detector 102 may be a detecting sensor configured to detect ejection failure by applying laser light to ejected ink to detect reflectance or transmittance of the applied laser light so as to determine the presence or absence of the ejected ink when ink is ejected from the plural ejecting nozzles. Alternatively, the ejection failure detector 102 may be a line sensor configured to read an image recorded by the recording head 101 to match the read data and input data so as to determine the presence or absence of the ejected ink when ink is ejected from the plural ejecting nozzles.

A data storage unit 103 is configured to store plural recording data to be processed by the recording head 101, and plural recording data corresponding to a color image expected to be formed by ejecting color ink by plural ejecting nozzles of the color ink recording heads 101CMY from which ejection failure are detected by the ejection failure detector 102. The data storage unit 103 is not specifically specified insofar as a unit capable of store data. The data storage unit 103 may be a storage unit typically used such as a random access memory (RAM).

The ejection failure compensation unit 104 is configured to compensate for an ejection failure of color ink by ejecting achromatic ink from the plural ejecting nozzles of the achromatic ink recording head 101G on the recording medium determined at originally expected pixel positions of color ink based on plural recording data corresponding to the originally expected pixel positions of the color ink stored in the data storage unit 103.

Note that the lightness value of the achromatic ink utilized for ejection failure may be a middle value between the maximum value and the minimum value of the lightness of the color gamut recorded in the recording medium. Alternatively, the lightness value of the achromatic ink utilized for ejection failure may be a middle lightness value between the highest lightness value of the color ink and the lowest lightness value of the color ink.

Figure 5:
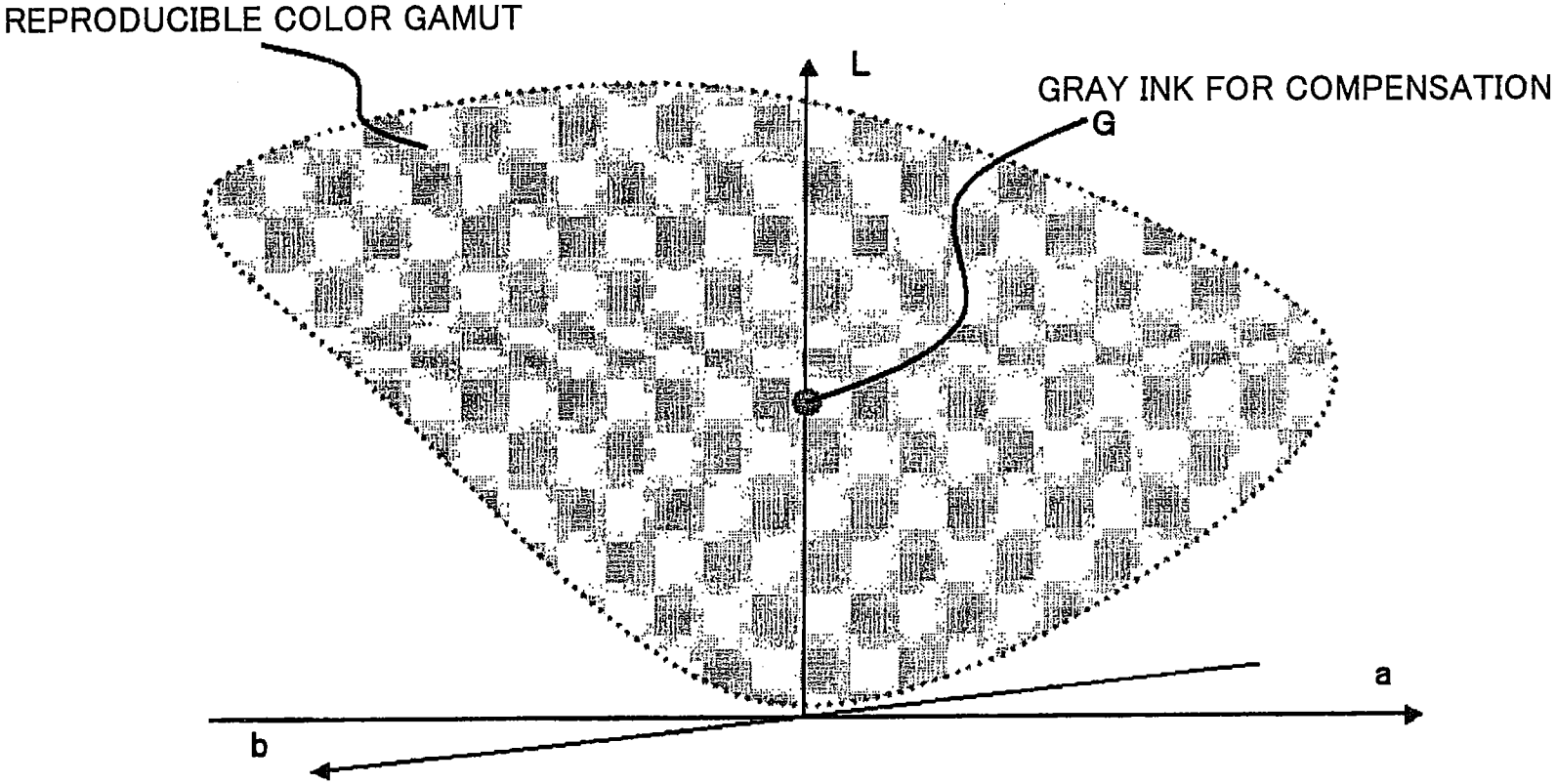
FIG. 5 is a simplified diagram illustrating a state in which compensating gray ink (i.e., gray ink for compensation) is applied to a center of a reproducible color gamut in the image forming method according to the embodiment.

FIG. 5 illustrates a case where the lightness of the achromatic ink utilized for the ejection failure is the middle value between the maximum value and the minimum value of the lightness of the color gamut recorded in the recording medium. In FIG. 5, an L-axis represents a lightness axis, an a-axis represents a red-green axis, and a b-axis represents a yellow-blue axis. The achromatic ink exhibits a light color when an L value is high, and exhibits a dark color when the L value is low. The achromatic color is observed at a point of intersection of the a-axis and the b-axis, and a higher chromatic color is observed in an outward direction (i.e., directions indicated by arrows). FIG. 5 is a diagram illustrating a color gamut capable of being recorded by the image forming apparatus observed in a Lab color space in which a position (G) of gray ink for compensation is indicated.

The achromatic gray has a property chromatically residing in a middle of the color gamut, and hence, the appearance difference (i.e., the color difference) of any colors recordable by the image forming apparatus may be made approximately at the same level. Technically speaking, the middle of the color gamut is not an achromatic color (i.e., white→gray→black axis) but is often slightly colored. However, when the colored ink is utilized for compensation, the color may be incongruent. Accordingly, it is preferable to utilize the achromatic gray color for compensation.

When the color gamut recordable by the image forming apparatus is specified, in particular, when the achromatic range is specified, lightness of a preferable achromatic ink may be specified. The recordable color gamut may be specified by measuring a white color of paper and a K-ink of the printed image. Specifically, lightness or density of the white color and the K-ink may be measured utilizing a measuring instrument such as a spectrodensitometer. The lightness and density may be obtained by printing a pattern for test printing on a recording medium (i.e., a recording sheet), and then the pattern printed with the K-ink and the white color of the recording sheet. The "recordable color gamut" is defined as a range of the measured result of the lightness or the density.

Figure 6:
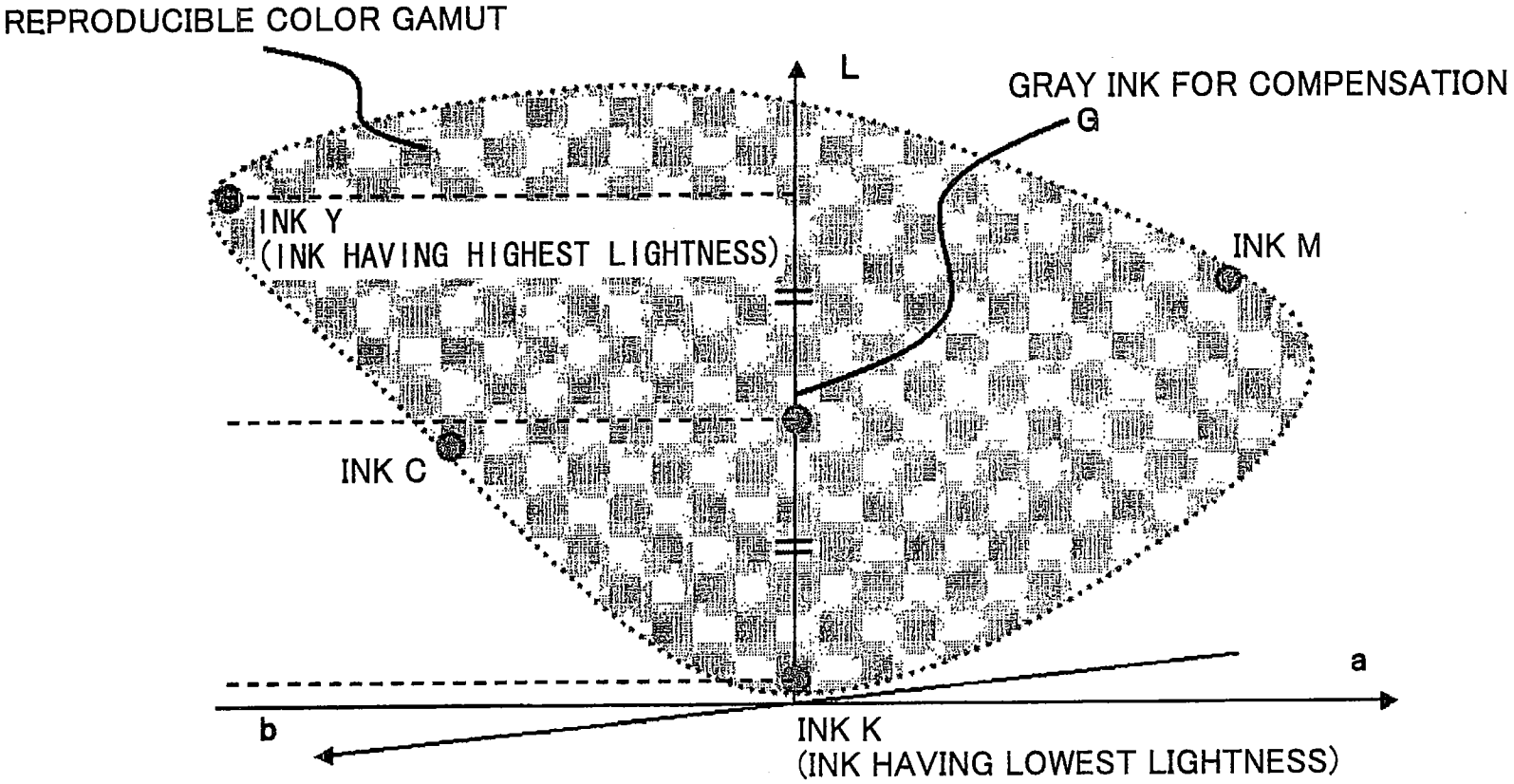
FIG. 6 is a simplified diagram illustrating a state in which compensating gray ink (i.e., gray ink for compensation) is applied as intermediate color between ink having the highest lightness and ink having the lowest lightness in the image forming method according to the embodiment.

Next, a case where the lightness value of the achromatic ink utilized for ejection failure is the middle lightness value between the highest lightness value of the color ink and the lowest lightness value of the color ink is illustrated with reference to FIG. 6. FIG. 6 is a diagram illustrating a color gamut capable of being recorded by a printer having CMYK ink that is observed in a Lab color space, and positions of respective monochromatic ink. Specifically, FIG. 6 illustrates a case where the middle position between the Y-ink having the highest lightness of the CMYK ink and the K-ink having the lowest lightness of the CMYK ink is gray ink for compensation.

Figure 8:
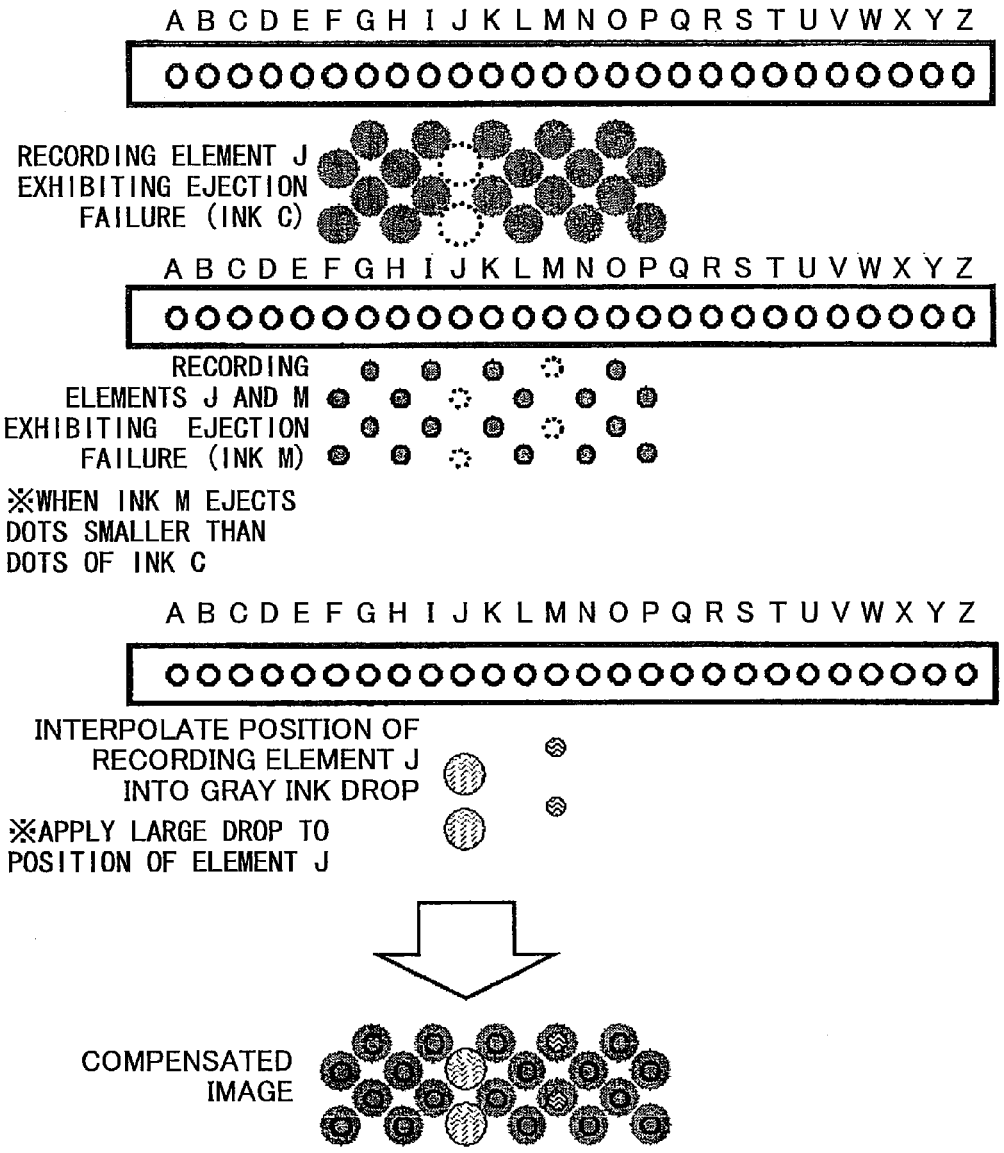
FIG. 8 is a simplified diagram illustrating liquid drop configuration in a case where plural color ejection failures are compensated by the same recording element.

Note that since the white color of the color gamut is changed by being affected by paper, the lightness value of the achromatic ink may be defined as the middle of the lightness values between the brightest color ink and the darkest color ink of the ink recordable by the image forming apparatus (i.e., the printer). For example, the lightness value of the achromatic ink may be the middle lightness between yellow (Y) and black (K) as illustrated in FIG. 8.

In recording an image by a printer serving as an image forming apparatus, "white" is generally defined as being not recorded on a recording medium. However, the lightness of white is the property of the recording sheet serving as the recording medium used. Therefore, the lightness of white may depend on what kind paper is used. It is preferable that the lightness of the gray ink utilized in this embodiment be the middle lightness of the recordable range, that is, the lightness between white and black. However, in a case where white is not uniquely determined as described above, the ink having the highest lightness such as the Y-ink among the inks installed by the printer may be used. It is preferable to utilize white ink in a case where the printer is installed with the white ink. Thus, the lightness of white is uniquely determined for selecting the gray ink.

Note that in one embodiment, the achromatic ink is not utilized for compensating ejection failure of the Y-ink, or the compensation ratio may be reduced. That is, since the viewability of the Y-ink is inferior, an adverse effect due to the ejection failure of the Y-ink may be unrecognized. Or, the viewability of the chromatic ink is superior, compensated parts may become distinctive. In this case, the compensation ratio may be reduced by thinning dots out or by decreasing the particle size of the ejecting dots. Note that in a case where the image is recorded by utilizing a combination of two or more colors, that is, a combination of the Y-ink and other colors, it is preferable to compensate for the Y-ink.

Further, in a case where an image subject to compensation has a high lightness, the compensation ratio may be reduced. That is, when the image color is light (pale), the compensated part may become distinct similar to the above-described reason. Note that the compensation ratio may be reduced in a manner similar to the above case.

Next, the data converter 105 is configured to convert plural recording data corresponding to expected pixel positions of color ink ejected by the plural ejecting nozzles of the ink-ejection failure detected color ink recording heads 101CMY into recording data corresponding to pixel positions of achromatic ink ejected by plural ejecting nozzles of the achromatic ink recording head 101G. That is, as illustrated in FIG. 7, in order to cause the achromatic ink recording head 101G to eject achromatic ink at the same positions to which the ejection failure detected ejecting nozzle of the color ink recording head is originally expected to eject the color ink, the data converter 105 converts the recording data corresponding to the expected positions of the color ink ejected by the color ink recording head into data corresponding to the positions of the achromatic ink ejected by the achromatic ink recording head 101G without altering the number of dots and/or the positions of the dots of the recording data held by the color ink recording head 101CMY.

Accordingly, the lightness or the color need not be adjusted by changing the positions of the dots, thereby ejection failure may be compensated without disunifying or defecting the image due to the altered positions of the dots.

Next, the first recording dot size determination unit 1041 is described. The first recording dot size determination unit 1041 is configured to determine a dot size for ejecting the achromatic ink at positions identical to the positions of the color ink recording data of the color ink recording heads 101CMY associated with the ejecting nozzles having ink-ejection failure based on dot size information of respective colors of the color ink recording data.

Figure 7:
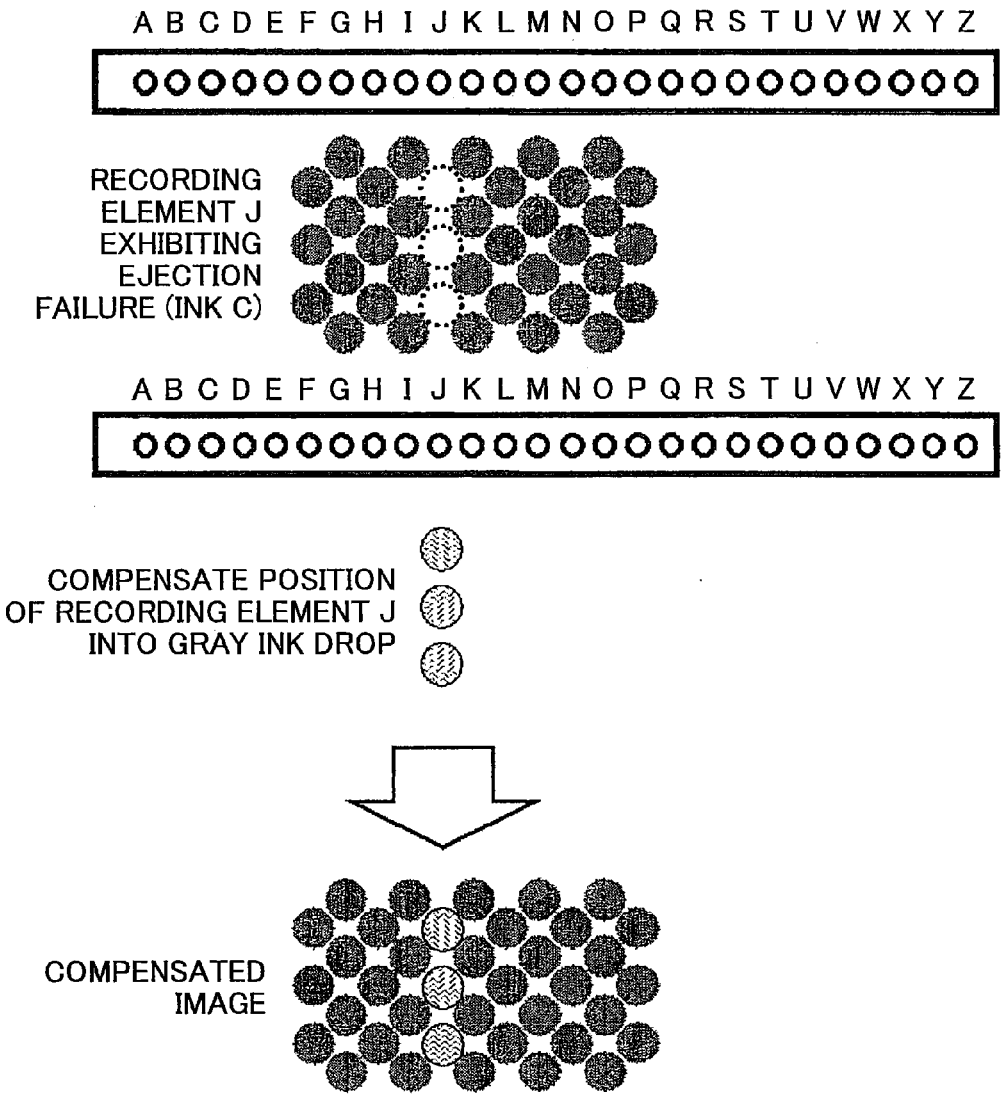
FIG. 7 is a simplified diagram illustrating recording positions of compensating dots in the image forming method according to the embodiment.

As illustrated in FIG. 7, an adverse effect on the image quality may be suppressed by compensating for dots at J positions originally expected to be formed by the color ink ejection by the ejection failure detected ejecting nozzles of the color ink recording heads 101CMY with dots formed with achromatic ink having the dot size identical to the expected dots. Note that FIG. 7 specifically illustrates an example of C-ink ejection failure; however, ejection failure of other ink may be similar to the example of the C-ink ejection failure.

Further, the first recording dot size determination unit 1041 is configured to determine a dot size of liquid drops to be ejected from the ejecting nozzles of the achromatic ink recording head 101G at predetermined pixel positions as a dot size greater than or equal to a dot size corresponding to the sum of plural color ink drops for forming an image corresponding to the recording data to be processed by the color ink recording head 101CMY.

Accordingly, the dot size of the achromatic ink drop utilized for compensating the ejection failure may be equated with the dot size of the sum of the plural color ink drops to be ejected by a failed recording element. Thus, an adverse effect, such as a color variability or defect, on the quality of the image on the recording medium formed after an ejection failure compensation process is performed. For example, as illustrated in FIG. 8, when the recording element M configured to eject M-ink having a dot size smaller than C-ink exhibits ejection failure, the ejection failure of the M-ink is compensated with gray ink having a dot size identical to that of the M-ink.

Next, the second recording dot size determination unit 1042 is described. As illustrated in FIG. 8, the second recording dot size determination unit 1042 is configured to determine the largest dot size among the plural color ink drops at an identical pixel position in the recording data, which is originally expected to be processed by the color ink recording heads 101CMY having the ejecting nozzle from which ejection failure is detected, as the drop size data to be processed by the achromatic ink recording head 101G. For example, as illustrated in FIG. 8, when the ejecting nozzle J exhibits ejection failure of C-ink and M-ink, the C-ink having a dot size greater than that of the M-ink is compensated with gray ink having a dot size identical to that of the C-ink.

When a dot size of one color ink, which is originally expected to be ejected by the failed color ejecting nozzle, is greater than the dot sizes of other color ink ejected by the same failed color ejecting nozzle, the color ink having the greatest dot size is determined as the dot size subjected to ejection failure compensation.

Further, when dot size data corresponding to the sum of the amount of the plural color ink drops corresponding to the recording data originally expected to be processed by the color ink recording heads 101CMY exceeds dot size data of achromatic ink capable of being ejected by the ejecting nozzles of the achromatic ink recording head 101G, the ejection failure compensation unit 104 may determine the greatest dot size data of ink capable of being ejected by the ejecting nozzles of the achromatic ink recording head 101G as dot size data for ejection failure compensation.

Accordingly, when dot size data of color ink drops originally expected to be ejected by the failed nozzle of the color ink recording heads 101CMY exceeds the dot size data of achromatic ink capable of being ejected by the nozzles of the achromatic ink recording head 101G, it may be unnecessary to determine the dot size of the achromatic ink for ejection failure compensation. Hence, the ejection failure compensation process may be easily and rapidly carried out.

Figure 9:
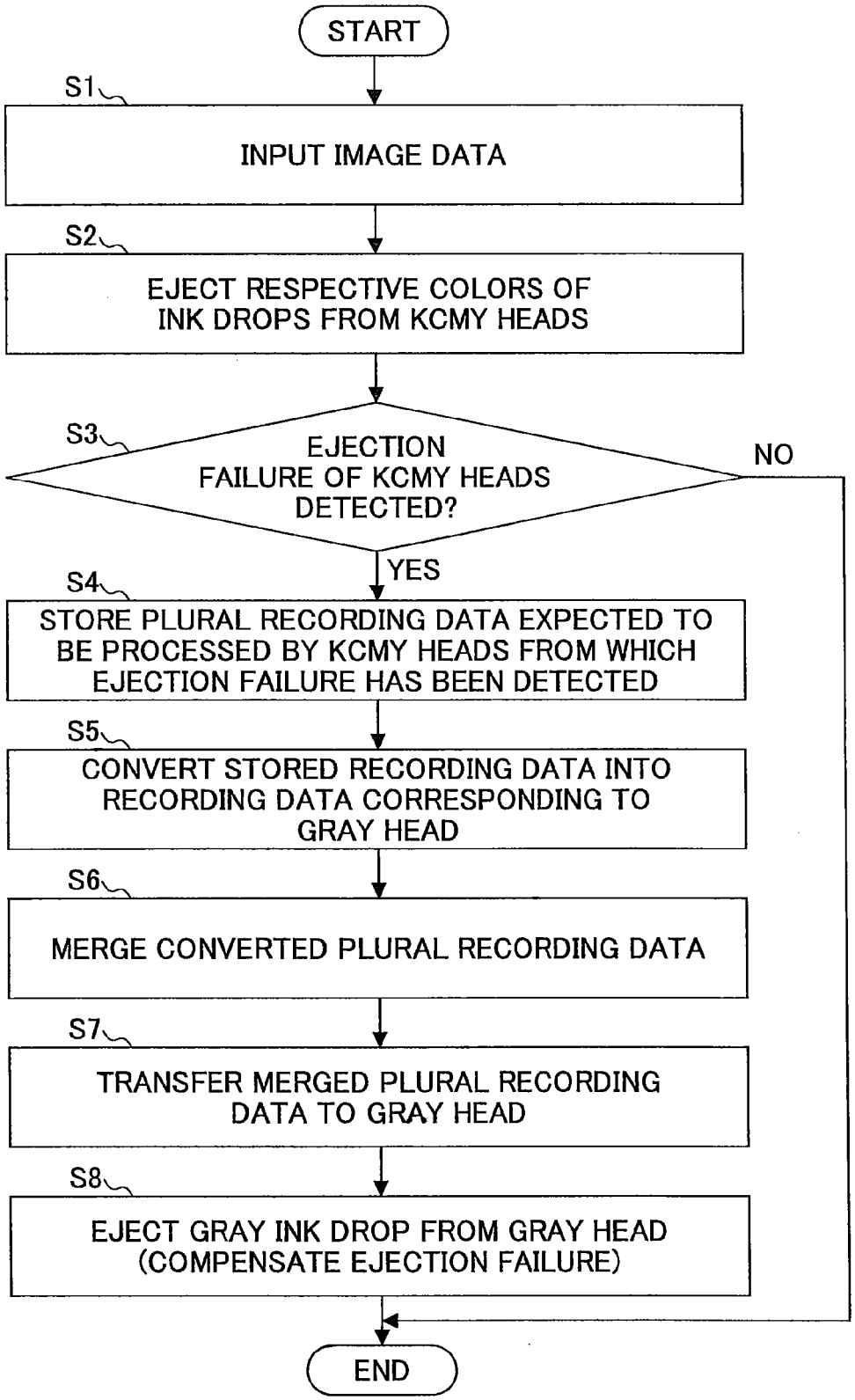
FIG. 9 is a flowchart illustrating a procedure of the image forming method according to the embodiment.

Next, a process of the image forming method according to the embodiment (i.e., an ejection failure compensation process) is described with reference to FIG. 9. Initially, image data for forming an image is input by a predetermined input unit (step S1). Subsequently, different colors of ink are ejected from the nozzles of the respective color ink recording heads (step S2). At this moment, ejection failure of the ejecting nozzle is detected (step S3). The process is terminated when the ejection failure of the ejecting nozzle is not detected ("NO" in step S3).

On the other hand, when the ejection failure of the ejecting nozzle is detected ("YES" in step S3), plural recording data originally expected to be processed by the detected failed nozzle are stored in the data storage unit 103 (step S4). Thereafter, the data converter 105 converts the plural recording data stored in the data storage unit 104 into recording data corresponding to the achromatic ink recording head 101G (step S5).

Subsequently, the converted plural data are merged (step S6). Thereafter, the merged recording data is transferred to the achromatic ink recording head 101G by a not-illustrated data converter (step S7). Gray ink is ejected from the nozzles of the achromatic ink recording head 101G based on the transferred recording data to complete the ejection failure compensation process (step S8). In the ejection failure compensation process, the number of the recording heads may be prevented from increasing by causing the nozzle of the achromatic ink recording head 101G to eject the achromatic ink as well as minimizing the color change due to the ejection failure compensation. Note that specific process contents of the respective units are already described above.

Note that there is a subtle difference in ejection detecting timing (step S3) between the serial printer and the line printer as illustrated below. Such a difference results from the difference in the recording system between the serial printer and the line printer.

(a) Serial Printer

In this embodiment, a part of an image is formed (recorded) with the K-ink and the CMY-ink (i.e., color ink) in one scanning reciprocation while ejection failure compensation is performed with gray ink. The serial printer is configured to perform an image forming method by repeatedly carrying out the above process to form an image corresponding to one page. Hence, the ejecting detection may need to be carried out in advance before the above sequence of the image forming operation. Then, the recording data is processed (converted and merged) based on the ejection failure detection result to eject the KCMY inks together with ejection of gray ink per scanning.

An adequate ejection failure detection timing as a unit may be one job. That is, it is adequate to perform the ejection failure per job (one printing instruction to print how many copies each composed of how many pages). Further, such ejection failure detection timing may be divided into details so as to carry out the ejection failure detection per page per scan.

(b) Line-Head Printer

In the line-head printer, it may be necessary to cause the ejection failure detector such as the above-described line sensor to detect ejection failure every time the KCYM inks are ejected. Note that the ejection order of the KCMY inks is not limited to this order. Since the line head of the line-head printer is configured to eject ink drops to form (record) an image while a sheet of paper passes through immediately beneath the color head array, one scanning may form an image of an entire one page.

Further, in the line-head printer, respective detectors corresponding to respective colors of nozzle arrays may need to be provided. That is, the ejection failed position (of the nozzle) may be detected before the ejection of gray ink, and hence, the ejection failed position may be detected after the ejection of respective colors of ink. The detected results (i.e., plural recording data originally expected to be processed by the failed color recording head 101) are merged in real time so as to specify a position to which gray ink is ejected by the gray nozzle until the detected results reach the nozzle array of the gray ink.

A method for specifying the position to which the gray ink is ejected by the gray nozzle may be as follows. In the ejection failure detection for each of the color ink recording heads, the position to which the gray ink is to be ejected may be specified by merging ejection failure detected positional data (i.e., plural recording data originally expected to be processed by the failed color recording head 101) by carrying out the logical OR. As a data processing method, a method including transferring the ejection failed positional data in real time and ejecting gray ink from the detected position, or a method including merging the ejection failure data when the positional data of four color inks are all detected and until a recording sheet reaches a position immediately beneath the gray nozzle array may be given.

In the image forming method according to the embodiment, the lightness of the achromatic ink utilized for the ejection failure may be the middle value between the maximum value and the minimum value of the lightness of the color gamut recorded in the recording medium. Even if the color recordable by the image forming apparatus includes variability or defect in carrying out the ejection failure compensation process, the appearance difference (i.e., the color difference) of any colors recordable by the image forming apparatus may be made approximately at the same level by utilizing gray as the achromatic color chromatically residing in the middle of the color gamut.

In the image forming method according to the embodiment, the lightness value of the achromatic ink utilized for ejection failure may be the middle lightness value between the highest lightness value of the color ink and the lowest lightness value of the color ink among the colors of ink. Accordingly, the gray ink having the appropriate lightness may be utilized as the ejection failure compensation ink without being affected by the difference in the lightness of white owing to types of the recording sheets serving as the recording medium.

The image forming method according to the embodiment may further include a data converting step to convert recording data corresponding to the failed color ink recording element for recording color dots into recording data corresponding to the achromatic ink recording element for recording the achromatic dots. Accordingly, the lightness or the color need not be adjusted by changing the positions of the dots, thereby ejection failure may be compensated without disunifying or defecting the image due to the altered positions of the dots.

In the image forming method according to the embodiment, the ejection failure compensation process further includes determining a first dot size for recording a dot with the achromatic ink at a pixel position identical to a pixel position of color recording data corresponding to the color ink recording element having the ejection failure, based on dot size information of the color recording data corresponding to the identical pixel position. Accordingly, the ejection failure compensation process is performed with the achromatic ink having a dot size identical to a dot size of the color dot originally expected to be recorded by the color ink recording element having the ejection failure, thereby suppressing an adverse effect on the image quality.

In the image forming method according to the embodiment, in the first recording dot size determination process, a dot size of the achromatic dot ejected from the achromatic ink recording element to a predetermined pixel position is determined as a dot size greater than or equal to a sum of an amount of color ink drops corresponding to the recording data originally expected to be processed by the color ink recording element for recording a color dot to the predetermined pixel position. Accordingly, the dot size of the achromatic ink drops utilized for compensating the ejection failure may be equated with the dot size of the sum of the amount of the color ink drops originally expected to be ejected by a failed color ink recording element. Thus, an adverse effect, such as color variability or defect, on the quality of the image on the recording medium formed after the ejection failure compensation process is performed.

In the image forming method according to the embodiment, the ejection failure compensation process further includes determining a second dot size for recording a dot with the achromatic ink at a pixel position identical to a pixel position of color recording data corresponding to the color ink recording element having the ejection failure as the largest dot size data of the color recording data corresponding to the identical pixel position. Accordingly, when a dot size of one color ink ejected by the failed color ink recording element is greater than the dot sizes of other color ink ejected by the same failed color ink recording element, the color ink having the greatest dot size is determined as the dot size subjected to ejection failure compensation.

In the image forming method according to the embodiment, in the ejection failure compensation process, a dot size for recording an achromatic dot at a pixel position to which at least one color dot is originally expected to be recorded on the recording medium as a largest dot size of the achromatic dot capable of being ejected from the achromatic ink recording element. Accordingly, when dot size data of color ink originally expected to be ejected by the color ink recording element having the ejection failure exceeds the dot size data of achromatic ink capable of being ejected by the achromatic ink recording element, it may be unnecessary to determine the dot size of the achromatic ink for compensating the ejection failure. Hence, the ejection failure compensation process may be easily and rapidly carried out.

According to the disclosed embodiments, in the ejection failure compensation process, the number of the recording heads may be prevented from increasing by newly adding the achromatic ink recording head, and causing the achromatic ink recording head to eject the achromatic ink as well as minimizing the color change due to the ejection failure compensation.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2012-061983 filed on Mar. 19, 2012, the entire contents of which are hereby incorporated herein by reference.

What is claimed is:

1. A method for forming a color image on a recording medium, the method being performed by an image forming apparatus having a head including a group of color ink recording elements for recording color dots composed of at least two colors of inks, a group of black ink recording elements for recording black dots composed of a black ink, a group of achromatic ink recording elements for recording achromatic dots composed of an achromatic ink substantially lying on the L axis in a three dimensional Lab color space, and having a lightness higher than a lightness of the black ink, and a data storage unit for storing data, the method comprising:

detecting an ejection failure of the group of the color ink recording elements;

storing recording data originally expected to be processed by at least one color recording element exhibiting the ejection failure of the color recording elements of the group in a case where the ejection failure is detected in the detecting step; and compensating for the ejection failure by recording one of the achromatic dots at a pixel position to which at least one color dot is originally expected to be recorded on the recording medium based on the recording data stored in the data storage unit, wherein a lightness value of the recorded achromatic ink dot is selected as the center point between a maximum value and a minimum value of a lightness of a color gamut recorded in the recording medium, where the red-green axis crosses the yellow blue axis.

2. A method for forming a color image on a recording medium, the method being performed by an image forming apparatus having a head including a group of color ink recording elements for recording color dots composed of at least two colors of inks, a group of black ink recording elements for recording black dots composed of a black ink, a group of achromatic ink recording elements for recording achromatic dots composed of an achromatic ink substantially lying on the L axis in a three dimensional Lab color space, and having a lightness higher than a lightness of the black ink, and a data storage unit for storing data, the method comprising:

detecting an ejection failure of the group of the color ink recording elements;

storing recording data originally expected to be processed by at least one color recording element exhibiting the ejection failure of the color recording elements of the group in a case where the ejection failure is detected in the detecting step; and compensating for the ejection failure by recording one of the achromatic dots at a pixel position to which at least one color dot is originally expected to be recorded on the recording medium based on the recording data stored in the data storage unit, wherein a lightness value of the recorded achromatic ink dot is selected as the center point lightness value between a highest lightness value of the color ink and a lowest lightness value of the color ink among the colors of ink where the red-green axis crosses the yellow blue axis.

3. The method as claimed in claim 1, further comprising:

converting recording data corresponding to the color ink recording element having the ejection failure into recording data corresponding to the achromatic ink recording element.

4. The method as claimed in claim 1, wherein the compensating step further includes determining a first dot size for recording a dot with the achromatic ink at a pixel position identical to a pixel position of color recording data corresponding to the color ink recording element having the ejection failure, based on dot size information of the color recording data corresponding to the identical pixel position.

5. The method as claimed in claim 4, wherein in the first recording dot size determination step, a dot size of the achromatic dot ejected from the achromatic ink recording element to a predetermined pixel position is determined as a dot size greater than or equal to a sum of an amount of color ink drops corresponding to the recording data originally expected to be processed by the color ink recording element for recording a color dot to the predetermined pixel position.

6. The method as claimed in claim 1, further comprising:

the compensating step further includes determining a second dot size for recording a dot with the achromatic ink at a pixel position identical to a pixel position of color recording data corresponding to the color ink recording element having the ejection failure as largest dot size data of the color recording data corresponding to the identical pixel position.

7. The method as claimed in claim 1, wherein in the compensating step, a dot size for recording an achromatic dot at a pixel position to which at least one color dot is originally expected to be recorded on the recording medium as a largest dot size of the achromatic dot capable of being ejected from the achromatic ink recording element.

8. An image forming apparatus comprising a head for forming a color image on a recording medium, wherein the head includes:

a group of color ink recording elements for recording color dots composed of at least two color inks;

a group of black ink recording elements for recording black dots composed of a black ink;

a group of achromatic ink recording elements for recording achromatic dots composed of an achromatic ink substantially lying on the L axis in a three dimensional Lab color space, and having a lightness higher than a lightness of the black ink and selected as the center point between a maximum value and a minimum value of a lightness of a color gamut recorded in the recording medium, where the red-green axis crosses the yellow blue axis;

an ejection failure detector configured to detect ejection failure of the group of the color ink recording elements for recording the color dots;

a data storage unit configured to store recording data originally expected to be processed by at least one color recording element having the detected ejection failure of the color recording elements of the group in a case where the ejection failure is detected by the ejection failure detector; and an ejection failure compensation unit configured to record one of the achromatic dots at a pixel position to which at least one color dot is originally expected to be recorded on the recording medium based on the recording data stored in the data storage unit.

* * * * *